US009097427B2

(12) United States Patent
Binzer

(10) Patent No.: US 9,097,427 B2
(45) Date of Patent: Aug. 4, 2015

(54) COOLING SYSTEM FOR GAS FIREPLACE

(71) Applicant: Canadian Heating Products Inc., Langley (CA)

(72) Inventor: Lothar Dan Binzer, Langley (CA)

(73) Assignee: CANADIAN HEATING PRODUCTS INC., Langley (CA)

( * ) Notice: Subject to any disclaimer, the term of this patent is extended or adjusted under 35 U.S.C. 154(b) by 313 days.

(21) Appl. No.: 13/906,837

(22) Filed: May 31, 2013

(65) Prior Publication Data

US 2014/0311478 A1 Oct. 23, 2014

(30) Foreign Application Priority Data

Apr. 19, 2013 (CA) ..... 2813871

(51) Int. Cl.

| | |
|---|---|
| ***F24B 1/187*** | (2006.01) |
| ***F24C 3/00*** | (2006.01) |
| ***F24C 7/08*** | (2006.01) |
| ***F24C 15/00*** | (2006.01) |
| ***F24C 15/20*** | (2006.01) |

(52) U.S. Cl.

CPC ..... *F24C 3/006* (2013.01); *F24C 7/081* (2013.01); *F24C 15/001* (2013.01); *F24C 15/006* (2013.01); *F24C 15/2021* (2013.01)

(58) Field of Classification Search

CPC ..... F24B 1/187; F24B 1/188; F24B 1/19
USPC ..... 126/503, 100 B, 61, 77, 152 B
See application file for complete search history.

(56) References Cited

U.S. PATENT DOCUMENTS

| | | | | |
|---|---|---|---|---|
| 4,129,114 | A | 12/1978 | Hiser | |
| 4,206,743 | A * | 6/1980 | Niemela | 126/110 B |
| 4,282,855 | A | 8/1981 | Perry | |
| 4,404,953 | A | 9/1983 | Thulman et al. | |
| 4,793,322 | A | 12/1988 | Shimek et al. | |
| 5,016,609 | A | 5/1991 | Shimek et al. | |
| 5,076,254 | A | 12/1991 | Shimek et al. | |
| 5,107,821 | A | 4/1992 | von Blanquet | |
| 5,253,635 | A | 10/1993 | Overall et al. | |
| 5,267,552 | A | 12/1993 | Squires et al. | |
| 5,320,086 | A | 6/1994 | Beal et al. | |
| 5,452,708 | A | 9/1995 | Shimek et al. | |
| 5,482,028 | A | 1/1996 | Binzer | |
| 5,542,407 | A | 8/1996 | Hawkinson | |
| 5,602,373 | A | 2/1997 | Sauer | |
| 5,647,340 | A | 7/1997 | Shimek et al. | |
| 5,647,341 | A | 7/1997 | Langman et al. | |
| 5,647,342 | A | 7/1997 | Jamieson | |

(Continued)

FOREIGN PATENT DOCUMENTS

| | | |
|---|---|---|
| CA | 2730807 A1 | 8/2012 |
| CA | 2736458 A1 | 8/2012 |

*Primary Examiner* — Gregory Huson
*Assistant Examiner* — Nikhil Mashruwala
(74) *Attorney, Agent, or Firm* — Smiths iP

(57) ABSTRACT

A power vented fireplace uses a single air inlet to pressurize a staging area from where air is distributed along a passageway between viewing panels to cool them as well as into the combustion chamber as a supply of combustion air. A partial restriction at an inlet to the passageway ensures that sufficient air is directed into the combustion chamber. The inlet to passageway may be adjustable to vary the extent of the restriction. Pressure differential switches may be used to ensure balanced operation of the fireplace.

12 Claims, 2 Drawing Sheets

(56) References Cited

U.S. PATENT DOCUMENTS

| | | | | | |
|---|---|---|---|---|---|
| 5,678,534 | A | | 10/1997 | Fleming | |
| 5,701,882 | A | * | 12/1997 | Champion | 126/523 |
| 5,807,098 | A | | 9/1998 | Deng | |
| 5,906,197 | A | | 5/1999 | French et al. | |
| 5,928,540 | A | | 7/1999 | Antoine et al. | |
| 5,941,231 | A | | 8/1999 | Garrett et al. | |
| 6,145,502 | A | * | 11/2000 | Lyons et al. | 126/512 |
| 6,295,981 | B1 | | 10/2001 | Beal et al. | |
| 6,425,390 | B2 | | 7/2002 | Campbell et al. | |
| 6,621,021 | B2 | | 9/2003 | Pechhold et al. | |
| 6,848,441 | B2 | | 2/2005 | Bachinski et al. | |
| 6,863,064 | B2 | | 3/2005 | Lyons et al. | |
| 6,910,478 | B2 | | 6/2005 | Kelly et al. | |
| 7,494,524 | B1 | | 2/2009 | Lehmann, Jr. | |
| 8,567,387 | B2 | * | 10/2013 | Binzer | 126/523 |
| 2005/0139209 | A1 | | 6/2005 | Deng | |
| 2007/0101987 | A1 | | 5/2007 | Atemboski et al. | |
| 2007/0221203 | A1 | | 9/2007 | Berg et al. | |
| 2012/0192853 | A1 | * | 8/2012 | Binzer | 126/512 |
| 2012/0192854 | A1 | | 8/2012 | Binzer | |

* cited by examiner

COOLING SYSTEM FOR GAS FIREPLACE

FIELD OF THE INVENTION

This invention relates to gas fireplaces. In particular, this invention relates to gas fireplaces in which combustion air is drawn from the outside and combustion products are vented to the outside.

BACKGROUND OF THE INVENTION

A common safety issue with windowed decorative gas fireplaces is the high temperatures that can exist on the window surface. A known method of cooling the exposed surfaces is through the use of inner and outer window panes. Cool air is passed between the two panes to keep the outer pane at a temperature that is safe to the touch. In different fireplaces, that is achieved in different ways.

U.S. Patent Publication No 2005/0139209 to Deng discloses a direct vent type of fireplace that has two separate sources of air. Cooling air is drawn from the room by a fan, is passed between the two panes, and then is released as warm air back into the room. Outside air used for combustion is drawn from the outside into the fireplace, where it is combusted, and then is exhausted outside through an air outlet vent. This fireplace requires at least two air intakes and two outlets. In the Deng type of fireplace, keeping the window panes cool enough to be safe to touch necessarily involves heating the room, which may not be desirable in some cases.

U.S. Pat. No. 5,542,407 to Hawkinson discloses (in Deng's FIG. 2) a system in which room air is still circulated, heated and returned to the room but in a path that does not cool the window panes. Cooling of the panes is by means of outside air that is drawn by natural draft venting through a coaxial vent, passes between the panes from top to bottom where it is then used as combustion air before being vented, again by natural draft venting through the coaxial vent. FIG. 3 of Hawkinson discloses a similar natural draft venting arrangement that does not include a room air heating path. Successful ignition and maintaining combustion in natural draft fireplaces can sometimes be a challenge.

An unvented fireplace is one that exhausts the combustion products directly into the room. U.S. Patent Publication No. 2012/0192854 to Binzer describes an unvented fireplace that has two window panes the exposed window being cooled by the flow of air between two panes. A single air inlet provides room air for both cooling and combustion and the cooling air and the combustion products are exhausted into the room. A restriction in the air pathway at the top of the fireplace promotes the preferential supply of air to the combustion chamber over the interstitial area between the panes.

U.S. Pat. No. 6,848,441 to Bachinski et al. discloses a window pane cooling system that includes an embodiment wherein the outer pane is positioned at an angle with respect to the inner pane. Such an angled pane is said to create a back pressure on the fireplace's blower to increase the flow of cooling air between the two panes. Bachinski et al. claim that the disclosed approach can be used with any type of fireplace, but they do not disclose further details about the supply of combustion air into the combustion chamber.

A prior art type of power vented fireplace that the present invention is intended to directly improve upon is shown in FIG. 1. The prior art fireplace may have one or more viewing sides. Combustion air enters from an outside air inlet and is passed into the combustion chamber. The combustion air flow is said to be "gravity fed". Air for cooling the viewing panes is drawn by means of cooling air inlet fans from the room and is passed between the two panes. Each side comprises at least one air inlet. The cooling air and combustion air are then mixed in an area above the combustion chamber before being exhausted outside through a single air outlet vent that is sometimes assisted by an exhaust fan. The combustion air is effectively drawn into the combustion air inlet by convection, through the suction created by the remote exhaust fan (if any) and by entrainment from the passing of the cooling air across the top of the combustion chamber. This configuration of power vented fireplace with dual window panes has proven problematic in relation to the balancing of the total air intake from the room air intake fan and outside air inlet with the air being vented out of the exhaust. Depending on the configuration of the mixing area above the combustion chamber and the exhaust fan, if the room air intake fan draws too much air it has a tendency to overpressure the mixing area and prevent air from exiting the combustion chamber thereby choking it and damaging components. When a building is under negative pressure compared to outside air, the tendency to block the combustion chamber outlet is enhanced. The problem may also be exacerbated where a building has fluctuating air pressures, for example restaurants that use exhaust hoods and fans that may be turned on and off at various times. The changes in air pressure in the building upsets the balance between the various fans causing similar problems to the ones noted above.

SUMMARY OF THE INVENTION

In one aspect, the invention comprises a power vented gas fireplace. A passageway is defined between two transparent walls or panels. A fan draws air from a single air inlet to pressurize a staging area or chamber that is upstream of the passageway and upstream of the combustion chamber. The staging area comprises a passageway inlet into the passageway. The passageway inlet preferably has a smaller opening or free area through the inlet than the cross-sectional area of the passageway itself whereby to create a restriction to air flow through the inlet.

The staging area also has one or more small openings into the combustion chamber. The openings from the staging area into the combustion chamber are relatively small so as to support a controlled and stable flame. The inlet fan induces a higher pressure in the staging area than in the combustion chamber causing air to flow through the openings into the combustion chamber, and a higher pressure than in the passageway to also cause air to flow through the passageway inlet into the passageway.

In another aspect, the invention is a power vented fireplace. The fireplace directs a single source of inlet air into the staging area that is pressurized by the air inlet fan and distributes the inlet air from the staging area into the combustion chamber through the small openings between the staging area and the combustion chamber and into the passageway through a passageway inlet that presents a partial restriction to air flow into the passageway. The passageway inlet may comprise an adjustable louver.

A combustion chamber outlet leads to a common mixing area downstream of the passageway and of the combustion chamber. The mixing area receives air from the passageway and combustion products from the combustion chamber and exhausts them to a common exhaust vent. An exhaust fan may also be used at the exhaust.

Control and balancing of the system may be facilitated by pressure differential switches that detect pressure differentials between the combustion chamber and the staging area, and/or between the combustion chamber and the exhaust vent or the common mixing area. The pressure differential switches may enable or disable the operation of the fireplace.

The free area of the passageway inlet and/or of the openings from the staging area into the combustion chamber may be adjustable to enable installers to balance the system for optimum operation. The passageway inlet may comprise for example an adjustable louver.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
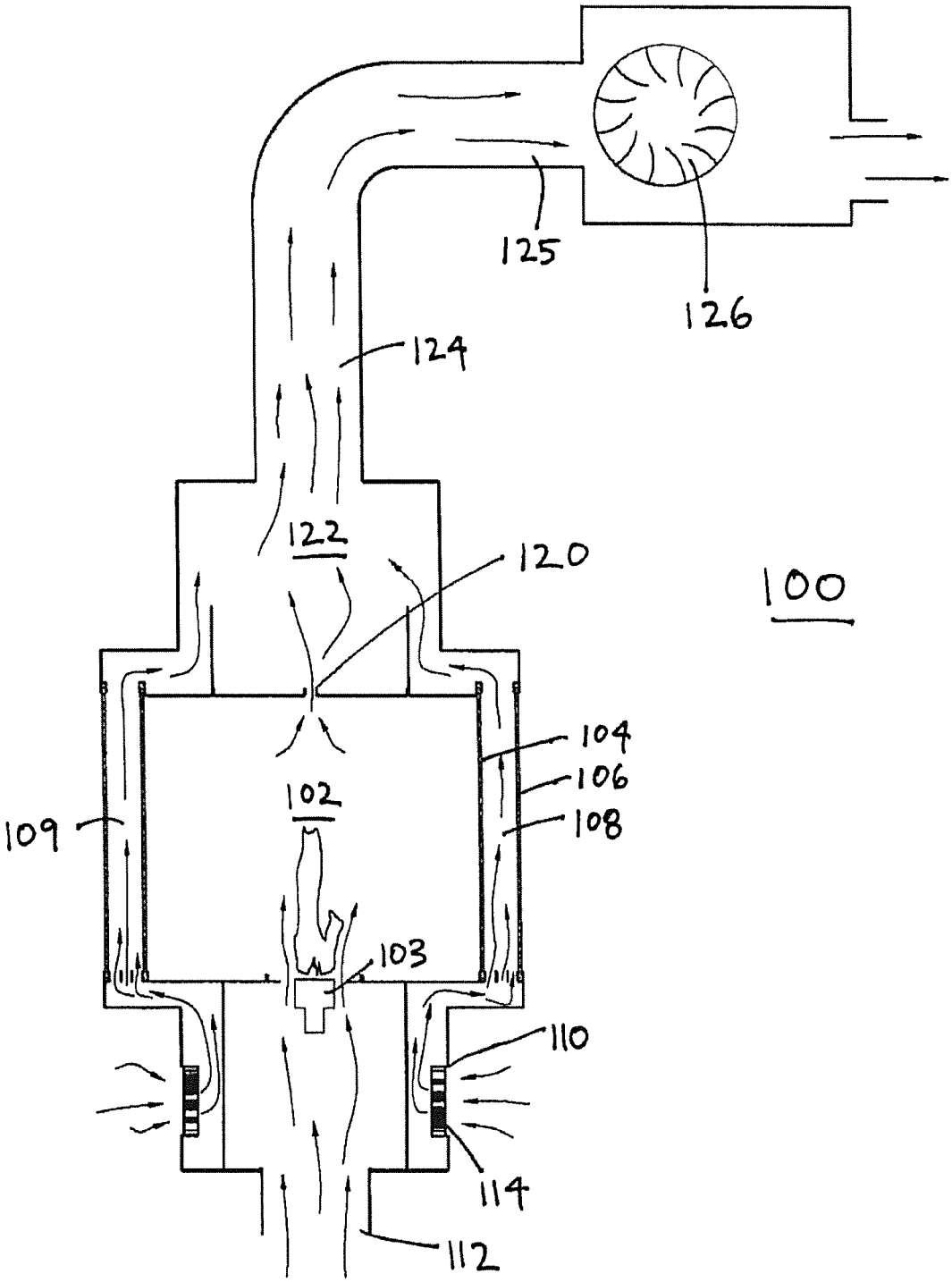
FIG 1 (PRIOR ART)
FIG. 1 is a side schematic view of a vented fireplace assembly according to the prior art.

FIG. 1 shows a style of prior art power vented fireplace over which the present invention is intended to be an improvement. Fireplace 100 comprises a combustion chamber 102 with a burner 103 and a transparent combustion chamber wall 104 to permit viewing inside the combustion chamber 102. A second transparent wall 106 is spaced from the combustion chamber 102 and creates an air passageway 108 between the two walls 104, 106.

Air enters the fireplace 100 from the room through a cooling air inlet 110 and from the outside through a combustion air inlet 112. A cooling air inlet fan 114 draws room air through the cooling air inlet 110 and into the air passageway 108. The flow of the cooling air through the air passageway 108 cools the second transparent wall 106 to a safe temperature. The same arrangement may be provided on the opposite side of the fireplace to define a second air passageway 109.

Combustion products leave the combustion chamber 102 through a combustion outlet 120 then mix with cooling air leaving the air passageways 108, 109 in an air mixing area 122. The mixed air then exits the fireplace 100 though an air outlet 124 into the exhaust venting system 125. A power vent 126 draws the mixed air from the exhaust vent 125 to the outside of the building.

Figure 2:
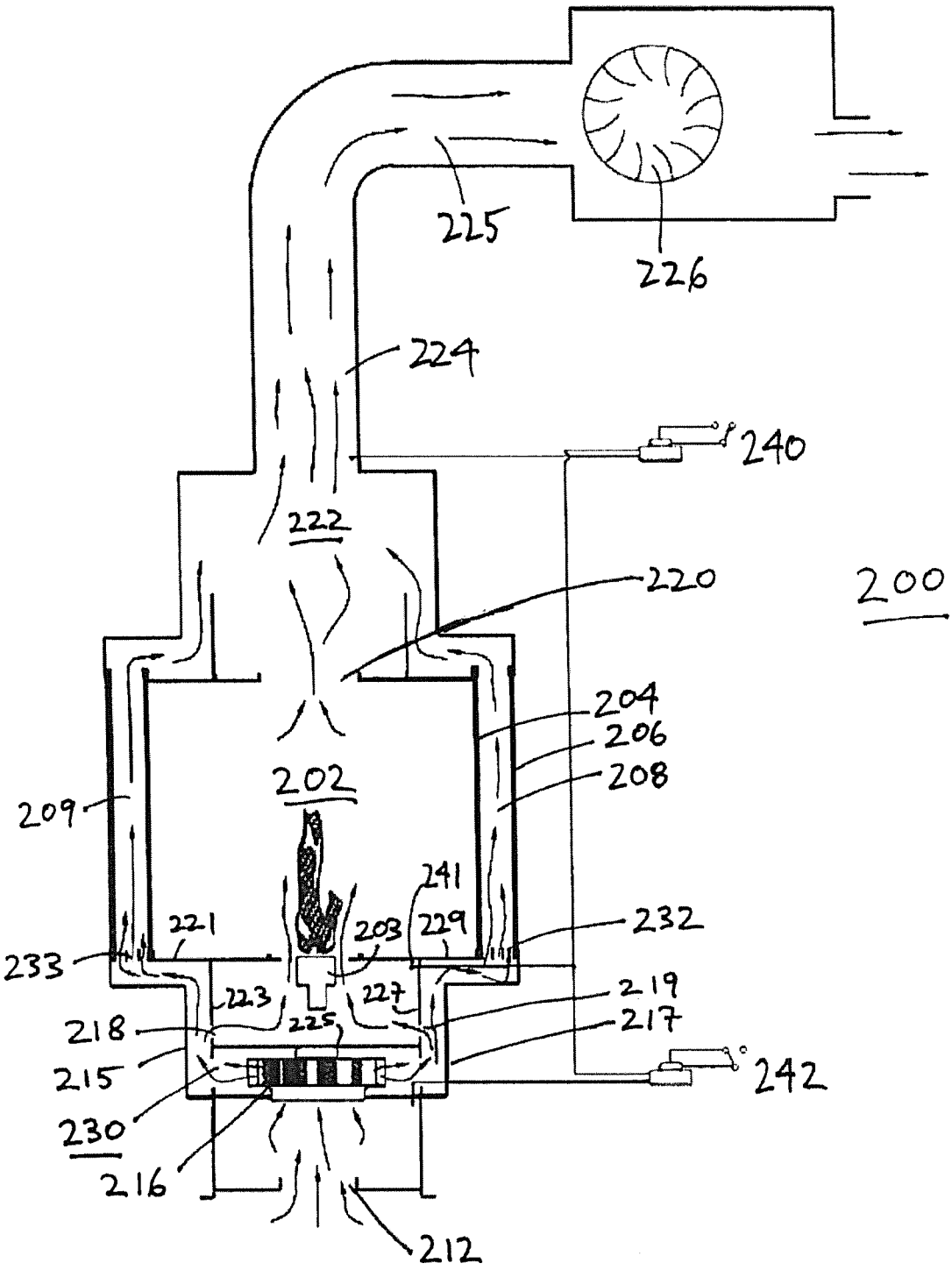
FIG. 2 is a side schematic view of a vented fireplace assembly according to one embodiment of the invention.

FIG. 2 shows the preferred embodiment of the present invention. Single-intake vented fireplace 200 comprises a combustion chamber 202 with a burner 203 and a first transparent combustion chamber wall 204 to permit viewing inside the combustion chamber 202. A second transparent wall 206 is spaced from the combustion chamber 202 so as to define an air passageway 208 between the transparent walls 204, 206. The same arrangement is provided on the opposite side of the fireplace to define a second air passageway 209, although that is not a necessary aspect of the invention.

Air is drawn into the fireplace 200 through a single air inlet 212 by means of an intake fan 216. The air drawn through the air inlet 212 is directed into a staging area 230 located upstream of the air passageways 208, 209. The staging area 230 may be a chamber or a relatively contained passageway enabling the intake fan 216 to pressurize the staging area 230. In the illustrated embodiment, staging area 230 is defined between exterior walls 215, 217 of the base of the fireplace, and walls 221, 223, 225, 227 and 229 of the base of the combustion chamber. The specific elements of the fireplace that make up the staging area 230 may vary provided that the staging area 230 acts to partially contain air drawn in by the intake fan 216 before flowing to the passageways 208, 209 and into the combustion chamber through the combustion chamber inlet(s) 218, 219.

Air flows from the staging area 230 into the passageways 208, 209 through passageway inlets 232, 233. Each of passageway inlets 232, 233 has a smaller free area (the aggregate area of its openings) than the cross-sectional area of the respective passageways 208, 209 themselves such that the inlets act as partial restrictions to the passage of air into the passageways.

The staging area 230 also includes one or more small combustion chamber inlets 218, 219. The relatively small size of the inlets 218, 219 contributes to a controlled and stable flame. In the preferred embodiment, each of inlets 218, 219 consists of a row of 0.50" diameter apertures spaced every 2" of length of the burner.

The staging area 230 is also defined at least in part by the partial restriction presented by the passageway inlets 232, 233 thereby inducing a higher pressure in the staging area 230 than in the combustion chamber 202 (and a higher pressure than in the passageways 208, 209).

As a result of the restrictions 232, 233, air is more reliably driven into the combustion chamber 202 than would be the case without the restrictions. Air from the staging area 230 also passes through the inlets 232, 233 and into the air passageways 208, 209. The outer transparent walls are cooled to a safe temperature by the flow of this air through the air passageways.

Air leaving the combustion chamber 202 through combustion outlet 220 mixes with air leaving the air passageway 208 in an air mixing area 222. The mixed air then exits the single-intake vented fireplace 200 though an air outlet 224. A power vent fan 226 draws the mixed air from an exhaust vent 225 and exhausts it to the outside of the building.

In an embodiment, the passageway inlets 232, 233 comprise adjustable louvers. Upon installation and set-up of the fireplace, the installer may adjust the louvers to provide more or less back pressure in the staging area 230 to ensure an adequate amount of ingress of air through openings 218, 219 and into the combustion chamber.

A first pressure differential switch 240 can be connected to the mixing area 222 or the air outlet 224 on the one hand, and a space 241 below the burner 203 in the combustion chamber 202 on the other hand. The first pressure differential switch 240 monitors to ensure that there is a higher air pressure in the combustion chamber 202 than in the air outlet 224. If the air pressure in the combustion chamber 202 falls below the air pressure in the air outlet 224, which can cause a reversal of the direction of the flames and burning of the fireplace components, the first pressure differential switch 240 triggers a shut off of the burner 203. The first pressure differential switch indirectly accounts for the pressurizing effect of the power exhaust vent 226.

A second differential pressure switch 242 can be connected to the single air inlet 212 and the combustion chamber 202. Any restriction or lack of air supply in the single air inlet 212 is monitored (indirectly) by the second differential pressure switch 242. A restriction or lack of air supply in the single air inlet 212 may cause the air pressure in the air inlet 212 to fall below the air pressure in the combustion chamber 202. If this occurs, the second pressure differential switch 242 will not permit the burner 203 to ignite or to continue operation.

A comparison of the air flow at the air inlet 242 and the outlet 224 allows the balancing of the total air inflow and outflow of the fireplace. In one embodiment, the fireplace is not allowed to ignite until the two air flows are within a predetermined range of one another.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

The invention claimed is:

1. A power vented gas fireplace having a combustion chamber with a first transparent panel for viewing into said chamber and a second transparent panel spaced from said first panel and defining a passageway between said first and second panels, said fireplace having a single air inlet, said fireplace directing inlet air into a staging area that is pressurized by a single air inlet fan and distributing said inlet air from said staging area into said combustion chamber through small openings between said staging area and said combustion chamber and into said passageway through a passageway inlet that presents a partial restriction to air flow into said passageway.

2. The fireplace of claim 1 wherein said passageway inlet comprises an adjustable louver.

3. The fireplace of claim 1 further comprising a common area downstream of said passageway and of said combustion chamber where air from the passageway and combustion products from the combustion chamber are mixed and said mixed air and combustion products are exhausted from said fireplace through a common exhaust vent.

4. The fireplace of claim 3 further comprising one or more pressure differential switches for measuring and comparing the pressures in said staging area and said combustion chamber.

5. The fireplace of claim 4 further comprising an exhaust vent and one or more pressure differential switches for measuring and comparing the pressures in said combustion chamber and in said exhaust vent.

6. A power vented gas fireplace having a combustion chamber, comprising:

a single air inlet for drawing air into the fireplace;

a single fan for drawing air into said air inlet;

a first transparent wall of said combustion chamber to permit viewing inside the combustion chamber and a second transparent wall spaced from said first transparent wall to define an air passageway between said first and second walls;

a staging area between said passageway and said air inlet, upstream of said passageway and upstream of said combustion chamber, for partially containing air drawn from said air inlet by said fan;

said staging area having one or more combustion inlet openings from said staging area into said combustion chamber;

said staging area having a passageway inlet into said passageway, said passageway inlet having a smaller free area through the inlet than the cross-sectional area of said passageway whereby to create a partial restriction to air flow through said passageway inlet acting to maintain an air pressure in said staging area that is elevated in relation to the air pressure in said combustion chamber whereby to cause air to be directed through said combustion inlet opening;

a common area for mixing air exiting from said passageway and combustion products exiting from said combustion chamber; and, an air outlet for exhausting air and combustion products to the outside.

7. The fireplace of claim 6, wherein said passageway inlet is a louver.

8. The fireplace of claim 7 wherein said louver is adjustable.

9. The fireplace of claim 6, further comprising a differential pressure switch wherein said differential pressure switch is connected to said air combustion chamber and said common area.

10. The fireplace of claim 9, wherein said differential pressure switch causes said fireplace to shut off if the pressure in said combustion chamber falls below the pressure in said common area.

11. The fireplace of claim 10, further comprising a pressure differential switch connected to combustion chamber and said staging area.

12. The fireplace of claim 11, wherein said switch causes said fireplace to shut off if the pressure in said combustion chamber is greater than the pressure in said staging area.

* * * * *